US005836590A

United States Patent [19]

Mitchell et al.

[11] Patent Number: 5,836,590

[45] Date of Patent: Nov. 17, 1998

[54] METHOD AND APPARATUS FOR SLOWING OR STOPPING A ROLLER SKATE

[75] Inventors: David N. Mitchell, Englewood; Gregory C. Sturgeon, Brighton; James R. Leto, Jr., Denver, all of Colo.

[73] Assignee: Out of Line Sports, Inc., Englewood, Colo.

[21] Appl. No.: 801,858

[22] Filed: Feb. 18, 1997

Related U.S. Application Data

[60] Provisional application No. 60/012,089 Feb. 22, 1996.

[51] Int. Cl.[6] ..... A63C 17/14

[52] U.S. Cl. ..... 280/11.2; 188/20; 188/29

[58] Field of Search ..... 280/11.2; 188/2 D, 188/4 B, 25, 29, 80

[56] References Cited

U.S. PATENT DOCUMENTS

| | | |
|---|---|---|
| 26,414 | 11/1859 | Napier . |
| 920,848 | 5/1909 | Eubank, Jr. . |
| 922,774 | 5/1909 | Kennedy . |

(List continued on next page.)

FOREIGN PATENT DOCUMENTS

| | | |
|---|---|---|
| 2055565 | 5/1992 | Canada . |
| 0 243 560 | 12/1986 | European Pat. Off. . |
| 0 379 906 | 1/1990 | European Pat. Off. . |
| 0 471 645 A3 | 7/1991 | European Pat. Off. . |
| 0 545 250 A2 | 11/1992 | European Pat. Off. . |
| 0 567 948 A1 | 4/1993 | European Pat. Off. . |
| 0 568 878 A1 | 4/1993 | European Pat. Off. . |
| 0 585 764 A1 | 8/1993 | European Pat. Off. . |
| 0 594 080 A2 | 10/1993 | European Pat. Off. . |
| 0 599 043 A2 | 10/1993 | European Pat. Off. . |
| 0 600 274 A1 | 11/1993 | European Pat. Off. . |
| 0 608 740 A2 | 1/1994 | European Pat. Off. . |
| 0 610 652 A1 | 1/1994 | European Pat. Off. . |
| 0 163 705 A1 | 2/1994 | European Pat. Off. . |
| 0 656 220 A2 | 10/1994 | European Pat. Off. . |
| 0 656 221 A1 | 11/1994 | European Pat. Off. . |
| 2 627 995 | 3/1988 | France . |
| 2 670 125 | 6/1990 | France . |
| 223485 | 11/1908 | Germany . |
| 230621 | 6/1910 | Germany . |
| 386288 | 12/1922 | Germany . |
| 438462 | 1/1925 | Germany . |
| 2305830 | 1/1938 | Germany . |
| 952 693 | 11/1956 | Germany . |
| 25 37 778 | 3/1977 | Germany . |
| 29 25 555 | 1/1981 | Germany . |
| 57-160483 | 2/1982 | Japan . |
| 89/03712 | 5/1989 | WIPO . |
| 93/14841 | 8/1993 | WIPO . |

*Primary Examiner*—D. Glenn Daydan
*Assistant Examiner*—Clovia Hamilton
*Attorney, Agent, or Firm*—Townsend and Townsend and Crew

[57] ABSTRACT

The invention provides a braking systems and methods for slowing or stopping a roller skate having a plurality of wheels. One exemplary system, at least one braking surface is spaced apart from the wheels. A means is provided between the braking surface and at least one of the wheels for slowing or stopping the wheel such that heat generated when slowing or stopping the wheel is created at the braking surface and is substantially prevented from reaching the wheel.

26 Claims, 10 Drawing Sheets

U.S. PATENT DOCUMENTS

| | | | |
|---|---|---|---|
| 979,169 | 12/1910 | Kennedy . | |
| 1,371,623 | 3/1921 | Ickenroth . | |
| 1,402,010 | 1/1922 | Ormiston . | |
| 1,456,881 | 5/1923 | Carley . | |
| 1,497,224 | 6/1924 | Ormiston . | |
| 1,524,286 | 1/1925 | Bried . | |
| 1,687,739 | 10/1928 | Slusher . | |
| 1,801,205 | 4/1931 | Mirick . | |
| 2,027,487 | 1/1936 | Means . | |
| 2,179,592 | 11/1939 | Goettie . | |
| 2,208,888 | 7/1940 | Whited . | |
| 3,062,328 | 11/1962 | Butler et al. | 188/33 |
| 3,224,785 | 12/1965 | Stevenson . | |
| 3,339,936 | 9/1967 | Hamlin . | |
| 3,528,672 | 9/1970 | Wunder . | |
| 3,583,052 | 6/1971 | Herbenar et al. | 29/175 |
| 3,734,244 | 5/1973 | Roddy . | |
| 3,767,220 | 10/1973 | Peterson . | |
| 3,876,217 | 4/1975 | Copier . | |
| 3,884,486 | 5/1975 | Wilje . | |
| 3,904,215 | 9/1975 | Bardy . | |
| 3,933,220 | 1/1976 | Swager | 182/3 |
| 4,003,582 | 1/1977 | Maurer . | |
| 4,003,596 | 1/1977 | Andorsen et al. . | |
| 4,033,433 | 7/1977 | Kirk | 188/25 |
| 4,048,938 | 9/1977 | Patterson, III et al. | 114/75 |
| 4,076,266 | 2/1978 | Krausz . | |
| 4,092,033 | 5/1978 | Swain . | |
| 4,108,451 | 8/1978 | Scheck, Sr. . | |
| 4,172,676 | 10/1979 | De Chant | 403/43 |
| 4,181,227 | 1/1980 | Balstad . | |
| 4,181,316 | 1/1980 | Brand et al. . | |
| 4,183,546 | 1/1980 | Heilig . | |
| 4,194,751 | 3/1980 | Shinmura . | |
| 4,275,895 | 6/1981 | Edwards . | |
| 4,300,781 | 11/1981 | Riggs . | |
| 4,312,514 | 1/1982 | Horowitz et al. . | |
| 4,363,493 | 12/1982 | Veneklasen . | |
| 4,402,520 | 9/1983 | Ziegler . | |
| 4,453,726 | 6/1984 | Ziegler . | |
| 4,526,389 | 7/1985 | Chase . | |
| 4,805,936 | 2/1989 | Krantz . | |
| 4,817,974 | 4/1989 | Bergeron . | |
| 4,852,697 | 8/1989 | Kulik | 188/2 |
| 4,943,072 | 7/1990 | Henig . | |
| 5,088,748 | 2/1992 | Koselka et al. . | |
| 5,118,122 | 6/1992 | Ricart . | |
| 5,125,687 | 6/1992 | Hwang . | |
| 5,171,032 | 12/1992 | Dettmer . | |
| 5,183,275 | 2/1993 | Hoskin . | |
| 5,183,292 | 2/1993 | Ragin, III . | |
| 5,192,099 | 3/1993 | Riutta . | |
| 5,193,827 | 3/1993 | Olson | 280/7.13 |
| 5,211,409 | 5/1993 | Mitchell et al. . | |
| 5,226,673 | 7/1993 | Cech . | |
| 5,251,934 | 10/1993 | Gates . | |
| 5,253,882 | 10/1993 | Mitchell . | |
| 5,280,930 | 1/1994 | Smathers et al. . | |
| 5,280,931 | 1/1994 | Horton . | |
| 5,286,043 | 2/1994 | Tkacyk . | |
| 5,308,093 | 5/1994 | Walin . | |
| 5,316,325 | 5/1994 | Mitchell et al. . | |
| 5,320,367 | 6/1994 | Landis . | |
| 5,330,207 | 7/1994 | Mitchell . | |
| 5,330,208 | 7/1994 | Charron et al. . | |
| 5,340,131 | 8/1994 | Smathers et al. . | |
| 5,342,071 | 8/1994 | Soo | 280/11.22 |
| 5,351,974 | 10/1994 | Cech | 280/11.2 |
| 5,374,070 | 12/1994 | Pellegrini | 280/11.2 |
| 5,374,071 | 12/1994 | Johnson . | |
| 5,375,859 | 12/1994 | Peck et al. . | |
| 5,388,844 | 2/1995 | Pellegrini, Jr. et al. . | |
| 5,397,137 | 3/1995 | Pellegrini, Jr. et al. | 280/11.2 |
| 5,397,138 | 3/1995 | Mangelsdorf . | |
| 5,398,948 | 3/1995 | Mathis | 280/11.19 |
| 5,401,038 | 3/1995 | Peck et al. . | |
| 5,403,021 | 4/1995 | Shifrin . | |
| 5,411,276 | 5/1995 | Moldenhauer . | |
| 5,415,419 | 5/1995 | Bourque . | |
| 5,435,579 | 7/1995 | Pozzobon | 280/11.2 |
| 5,439,238 | 8/1995 | Neal . | |
| 5,462,296 | 10/1995 | Pozzobom | 280/11.2 |
| 5,462,297 | 10/1995 | Lee . | |
| 5,478,094 | 12/1995 | Pennestri . | |
| 5,501,474 | 3/1996 | Conte . | |
| 5,511,803 | 4/1996 | Klukos . | |
| 5,511,804 | 4/1996 | Pellegrini, Jr. et al. | 280/11.2 |
| 5,511,805 | 4/1996 | McGrath . | |
| 5,551,712 | 9/1996 | Repucci . | |
| 5,564,718 | 10/1996 | Mitchell et al. . | |
| 5,570,759 | 11/1996 | Zorzi | 188/5 |
| 5,582,418 | 12/1996 | Closser . | |
| 5,630,596 | 5/1997 | Rudolph | 280/11.2 |
| 5,647,599 | 7/1997 | Visger | 280/11.2 |
| 5,685,550 | 11/1997 | Mayer, II | 280/11.2 |
| 5,704,618 | 1/1998 | Sfoggia | 280/11.2 |
| 5,755,449 | 5/1998 | Pozzobon | 280/11.2 |

METHOD AND APPARATUS FOR SLOWING OR STOPPING A ROLLER SKATE

CROSS-REFERENCE TO RELATED APPLICATION

This application is a continuation-in-part of provisional application Ser. No. 60/012,089, filed on Feb. 22, 1996, the complete disclosure which is incorporated herein by reference.

BACKGROUND OF THE INVENTION

This invention relates generally to the field of roller skates. More particularly, this invention relates to a roller skate brake which slows or stops the skate by engaging at least one of the wheels while preventing heat energy that is created from slowing the wheel from transferring to the wheel.

Traditional roller skates, having set the wheels in tandem, have long been used in the relatively controlled environment of a skating rink. In a skating rink, the skating surface is typically flat and smooth, and skaters travel in the same direction around an oval or circular track. Hence, there are few unexpected hazards. Therefore, there has been little need for an effective brake on the traditional roller skate.

Recently, however, a faster and more maneuverable type of roller skate has been introduced. Such skates, known as "in-line" skates with wheels mounted in line rather than in tandem can function similar to an ice skate. In-line skates are offered in the U.S. by several vendors, including Rollerblade, Variflex, Bauer, and California Pro. In-line skates appeal to the athletic old and young adults and hence persons who enjoy the outdoors. Such skates are commonly used outside, on uneven sidewalks, bicycle paths, and roads. One appealing feature of the in-line skates is the high speed that can be achieved. However, this may become hazardous the skater and others when skating more rapidly than conditions allow. Hence, a variety of brakes for in-line skates have been proposed.

One proposed brake for in-line skates involves a thick friction pad that extends behind the heel of the skate. The thick friction pad is disposed above the skating surface and is made to swing down towards the skating surface by the skater's pivoting the skate about the axis of the rear wheel. As the skater raises the toe of the skate and rotates the heel downward, the friction pad behind the heel will contact the ground and stop the skate. Brake systems have also been used on tandem wheel skates which may also include (because the speeds are not so high with tandem wheel skates) a fixed friction pad that extends in front of the toe of the skate. In this case, the skater brings the friction pad to bear on the skating surface by raising the heel and lowering the toe. Such brake systems require either the toe to be raised or lowered suffer from a number of serious drawbacks including skater fatigue in operating the brake and difficulty in maneuvering the skate to engage the brake with the skating surface.

One particularly useful type of brake which does not require the toe to be raised or lowered is a mechanically activated brake which engages the ground to slow or stop the brake as described in U.S. Pat. Nos. 5,211,409; 5,253,882; 5,316,325; 5,330,207; 5,564,718, and copending U.S. application Ser. No. 08/571,795, filed Dec. 13, 1995, the complete disclosures of which are incorporated herein by reference. One particular brake system that is described in some of these patents includes a carriage that pivots about the rear of the skate so as to bring the brake pad into contact with the skating surface when activated by an actuator which does not require either the heel or the toe to be lowered.

Although some of such braking systems which engage a braking pad with a skating surface have proven to be generally successful in slowing or stopping the roller skates, it would be desirable in certain cases to provide a braking system for a roller skate where ground engagement is not needed. In this manner, the need to place a pad on the ground to slow or stop a skate will be eliminated. This in turn, will provide improved control since the skater will not have a braking pad engaging the ground while slowing or stopping the skate. Further, it will eliminate the interference of the brake with the toe of the other foot when performing cross-overs. Moreover, elimination of a bulky braking pad will make the skate more aesthetically pleasing. Some previously proposed braking systems have employed a brake pad which directly engages the wheel to slow or stop the skate. However, such a configuration is undesirable in that heat is created directly on the wheel's surface when the braking pad engages the wheel. Such heat may cause the wheels to melt, particularly since many wheels are now commonly constructed of urethane.

Hence, for these and other reasons, it would be desirable to provide a skate braking system which will slow or stop a skater without engaging a brake pad with the ground and without excessively heating the wheels of the skate. Among other advantages, such braking system should be relatively easy to use and should not be bulky so as to interfere with the skater's movements.

SUMMARY OF THE INVENTION

The invention provides braking systems and methods for slowing or stopping a roller skate. In one exemplary braking system, at least one braking surface is spaced apart from a plurality of wheels. A means is provided between the braking surface and at least one of the wheels for slowing or stopping the wheel, such that heat generated when slowing or stopping the wheel is created at the braking surface and is substantially prevented from reaching the wheel.

The braking system will be particularly useful when the wheels of the roller skate are in line with each other. When the wheels are in line with each other, the means for slowing or stopping is preferably positioned between two of the in line wheels so that two of the wheels may be slowed or stopped at substantially the same time. In one particularly preferred embodiment, the means of slowing or stopping comprises a rotatable member which may be positioned to contact one of the wheels when rotating. When the rotatable member is positioned against the wheel, the rotatable member will freely rotate. A portion of the rotatable member is then engaged with the braking surface to gently slow rotation of the rotatable members. Since the rotatable member is in contact with the wheel, as the rotatable member is slowed by the braking surface, the wheel will also slow. Preferably, the rotatable member will be engaged with the wheel such that no slippage will occur between the wheel and the rotatable member. In this way, little or no heat will be generated at the interface between the wheel and the rotatable member. Hence, with such a configuration, rotation of the wheel will be gently slowed while the heat generated between the braking surface and the rotatable member will be away from the wheel so as to not damage the wheel.

In another aspect of the system, an actuator is provided which positions the rotatable member against the wheel and also engages the braking surface with the rotatable member. One particularly preferable actuator comprises a cam which moves the rotatable member into contact with the wheel upon rotation of the cam. A variety of mechanisms can be employed to rotate the cam including a cable, rod, or the like (which in turn may be connected to the cuff of the boot so that movement of the skater's leg may rotate the cam) an air cylinder, a hydraulic cylinder, and the like.

In still another aspect, the system further includes an elastomeric housing, with the braking surface being formed within the housing. The rotatable member is rotatably attached to the housing so as to be spaced apart from the braking surface. In this manner, rotation of the cam forces the braking surface against the rotatable member after the rotatable member contacts the wheel.

The invention further provides a braking system for roller skates having a plurality of in-line wheels which rotate from the roller skate when rolling over a skating surface. The system comprises a rotatable member which may be positioned to contact at least one of the wheels when rotating. When the rotating member is positioned against the wheels, the rotatable member freely rotates. A braking surface is provided and is engageable with the rotatable member so that as the rotatable member engages the braking surface, the rotatable member will be slowed which in turn gently slows rotation of the in-line wheel.

In a preferable aspect, the rotatable member may be positioned to contact two of the in-line wheels at substantially the same time. In this manner, both of the wheels will be slowed at substantially the same rate thereby preventing one of the wheels from "locking up". In another aspect, at least a portion of the rotatable member is thermally conductive so that heat generated between the rotatable member and the braking surface may be dissipated into the atmosphere before reaching the wheels. An exemplary material for constructing the rotatable member is aluminum. A plurality of heat transfer ribs may also be provided on the rotatable member to assist in dissipating the heat. The rotatable member may also include insulation for preventing heat generated at the braking surface from transferring to the wheel.

In yet another aspect, an actuator is provided which positions the rotatable member against the wheel and engages the braking surface with the rotatable member. One particularly preferable actuator is a cam which may be rotated within a groove of an elastomeric housing. The braking surface is formed within the housing, and the rotatable member is rotatably attached to the housing so as to be spaced apart from the braking surface. In this way, rotation of the cam forces the braking surface against the rotatable member after the rotatable member has moved into contact with the wheels. Usually, the cam will be rotatably connected to a skate frame.

The invention further provides a roller skate comprising a brake and a frame which connects a plurality of in-line wheels to the boot. A braking surface is operably attached to the frame, and a means is provided between the braking surface and at least one of the wheels for slowing or stopping the wheel. The means for slowing or stopping is configured so that heat generated when slowing or stopping the wheel is created at the braking surface and is substantially prevented from reaching the wheel.

The invention provides an exemplary method for slowing or stopping a moving roller skate. According to the method, a rotating wheel of the roller skate is contacted with a rotatable member. The rotatable member is then slowed such that heat energy created in slowing the rotatable member is substantially prevented from reaching the wheel. The rotatable member is preferably gently slowed so that no jerking action will result when slowing or stopping the wheel.

The rotatable member will preferably be slowed by positioning the braking surface against a rotatable member such that substantially no slippage is created between the wheel and the rotatable member.

In another aspect to the method, the roller skate preferably includes an elastomeric housing having the braking surface formed therein, and the rotatable member being rotatably attached to the housing so as to be spaced apart from the braking surface. In this manner, a rotatable member may be positioned against the braking surface by compressing the housing to force the braking surface against the rotatable member after the rotatable member contacts the wheel. The braking surface will preferably be positioned against the rotatable member by rotating a cam. An exemplary aspect, rotation of the cam will result from rotating a cuff on a roller skate.

DETAILED DESCRIPTION OF THE SPECIFIC EMBODIMENTS

The invention provides braking systems and methods for slowing or stopping a roller skate without engaging a braking pad with the skating surface and without generating a significant amount of heat on the wheels of the skate when the skate is being slowed or stopped. Although the systems and methods may be used with virtually any type of roller skate, they will find their greatest use with in-line roller skates.

Figure 1:
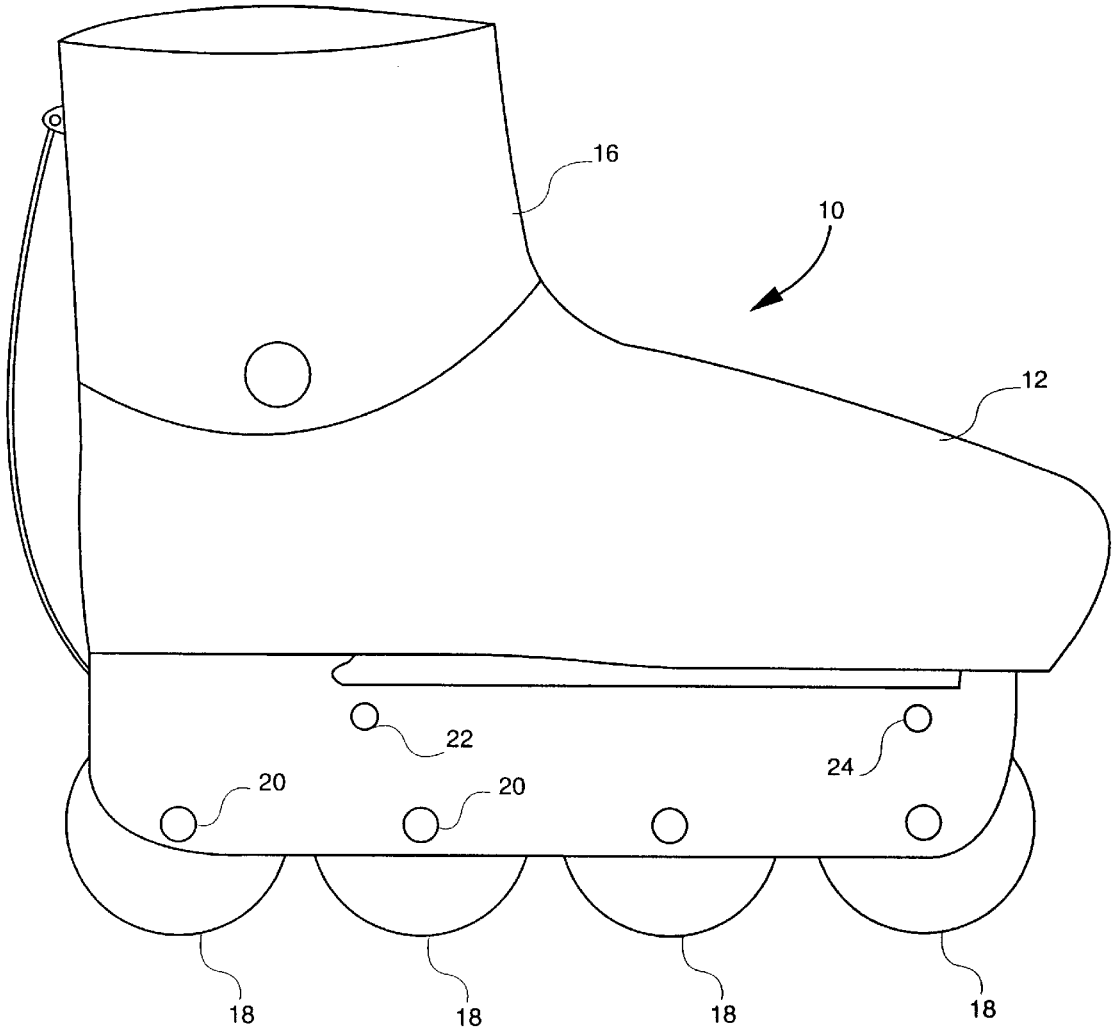
FIG. 1 is a perspective view of a roller skate having a braking system according to the present invention.

Referring now to FIG. 1, an embodiment of an in-line roller skate 10 which may incorporate braking systems according to the present invention will be described. Skate 10 includes a boot 12 and a frame 14 attached to or integrally formed with boot 12. Boot 12 may optionally include a rotatable cuff 16 which may be employed to actuate braking systems of the invention as described in greater detail hereinafter. Frame 14 holds a plurality of wheels 18 in line with each other and along a longitudinal axis of the skate. Wheels 18 are held to frame 14 by axles 20. Frame 14 further includes a pair of mounting holes 22 and 24 for mounting a braking system as described next with reference to FIGS. 2 and 3.

Figure 2:
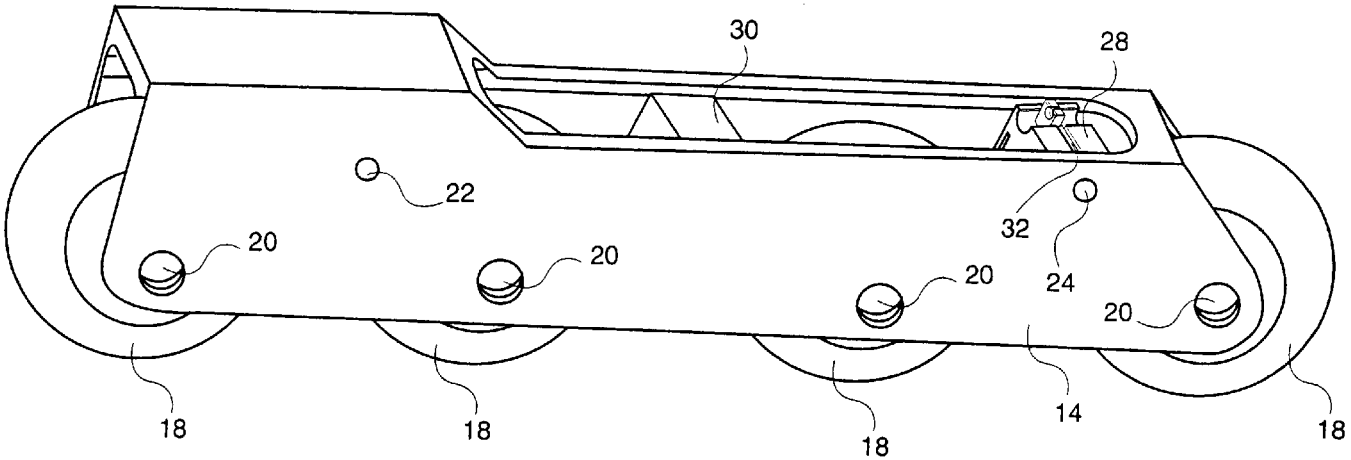
FIG. 2 is a perspective view of a frame of the roller skate of FIG. 1 which holds a plurality of wheels and the braking system.
Figure 3:
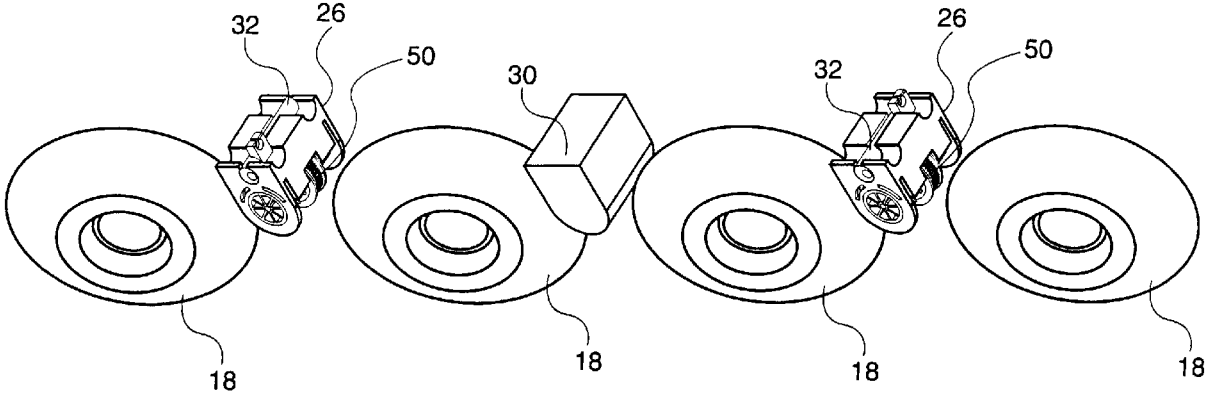
FIG. 3 is a perspective view of the wheels and the braking system of FIG. 2 with the frame shown removed.

Referring now to FIGS. 2 and 3, frame 14 holds a pair of braking units 26 and 28 above wheels 18. Braking unit 26 is attached to frame 14 at mounting hole 22 and braking unit is attached to frame 14 and mounting hole 24. Braking units 26 and 28 are held by frame 14 such that each braking unit is positioned in between and above two of the wheels 18 as shown. A spacer bar 30 is positioned between the two inner wheels. Braking units 26 and 28 are attached to frame 14 by pins (not shown) extending through an eccentric cam 32 and terminating in mounting holes 22 and 24, respectively.

Figure 4:
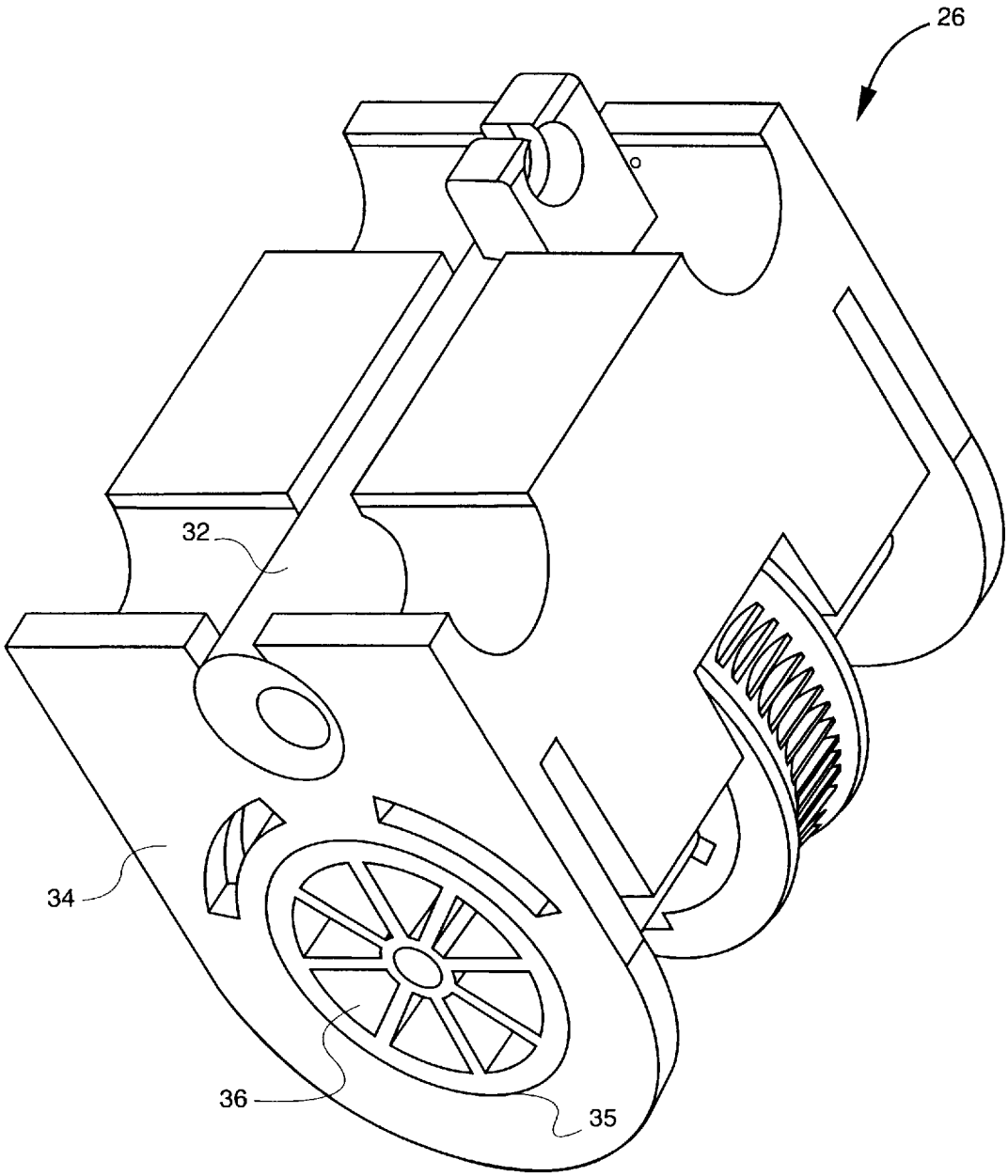
FIG. 4 is a perspective view of a braking unit of the braking system illustrated in FIGS. 2 and 3.
Figure 5:
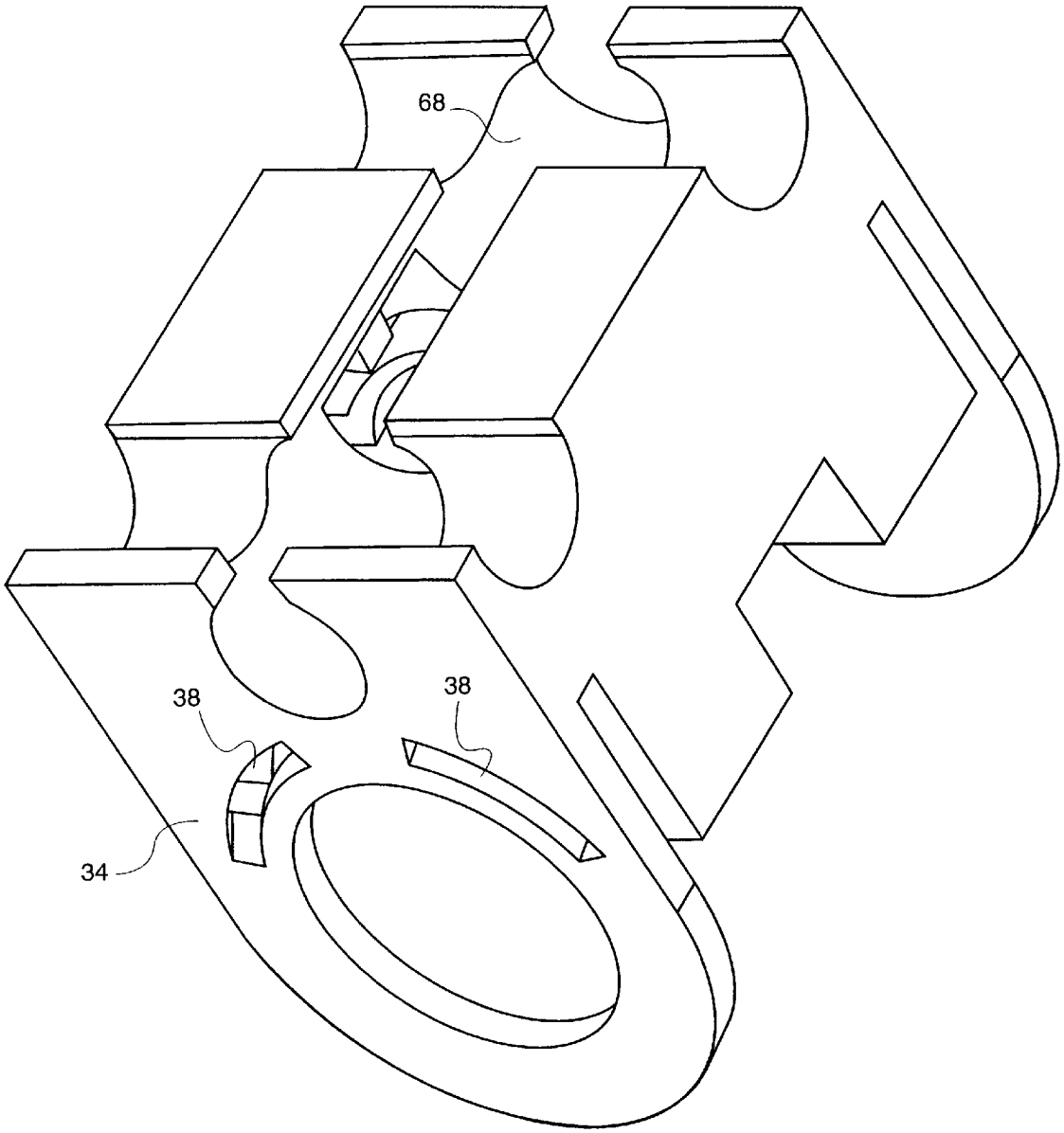
FIG. 5 is a perspective view of an elastomeric housing of the braking unit of FIG. 4.
Figure 6:
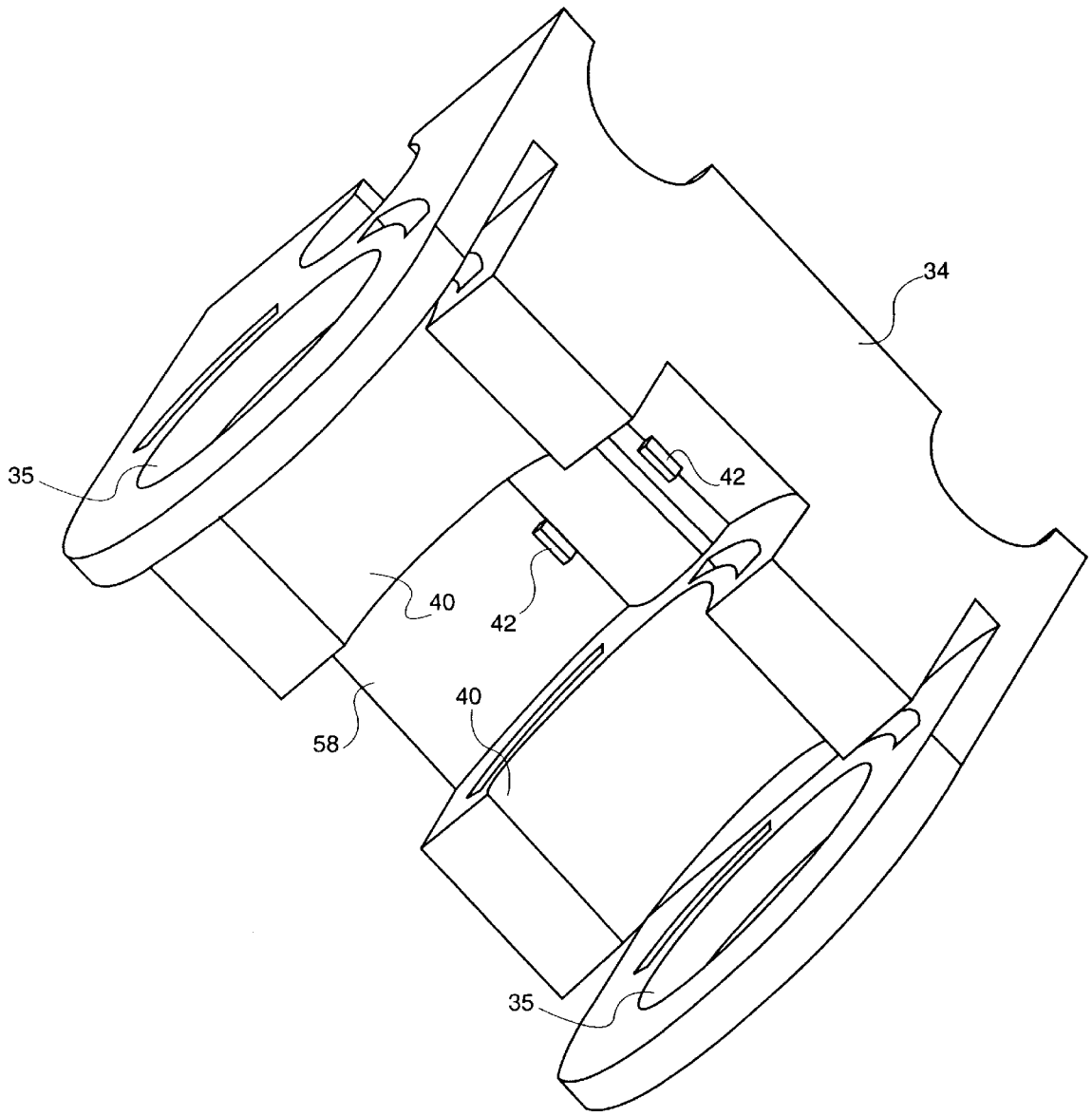
FIG. 6 is a perspective view of the elastomeric housing of FIG. 5 showing a pair of braking surfaces.

Referring to FIG. 4, construction of braking unit 26 will be described in greater detail, it being understood that braking unit 28 is essentially identical to braking unit 26. Braking unit 26 comprises an elastomeric housing 34 which rotatably receives cam 32 and rotatable member 36. Elastomeric housing 34 is shown separately in FIGS. 5 and 6. Elastomeric housing is preferably constructed of an elastomer, such as rubber, so that housing 34 will be able to compress at slit 38 (see FIG. 5) and to withstand heat created at braking surfaces 40 (see FIG. 6) as described hereinafter. Tabs 42 may optionally be provided as wear indicators to indicate when braking surfaces 40 have become excessively worn.

Figure 7:
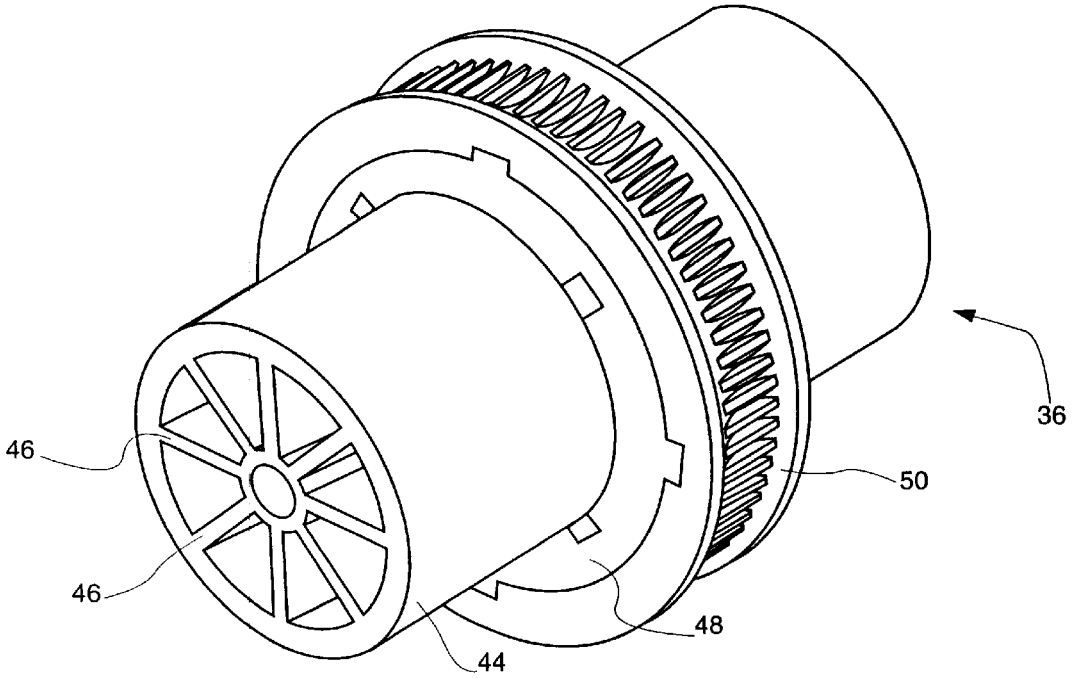
FIG. 7 is a perspective view of a rotatable member of the braking unit of FIG. 4.

Referring now to FIG. 7, construction of rotatable member 36 will be described in greater detail. Rotatable member 36 comprises a hollow shaft 44 having heat transfer fins 46. When rotatable member 36 is held within elastomeric housing 34 (see FIG. 4) shaft 44 is spaced apart from braking surfaces 40 (see FIG. 6). Shaft 44 is preferably constructed of a thermally conductive material such as aluminum, copper, steel, plastic, ceramic, and the like so that heat generated between shaft 44 and braking surfaces 40 will be transferred through fins 46 and will dissipate into the atmosphere, thereby preventing the heat from reaching wheels 18 (see FIG. 1). An insulating cylinder 48 is placed around shaft 44 for preventing heat from shaft 44 from transferring through a gear 50 to wheels 18.

Figure 8:
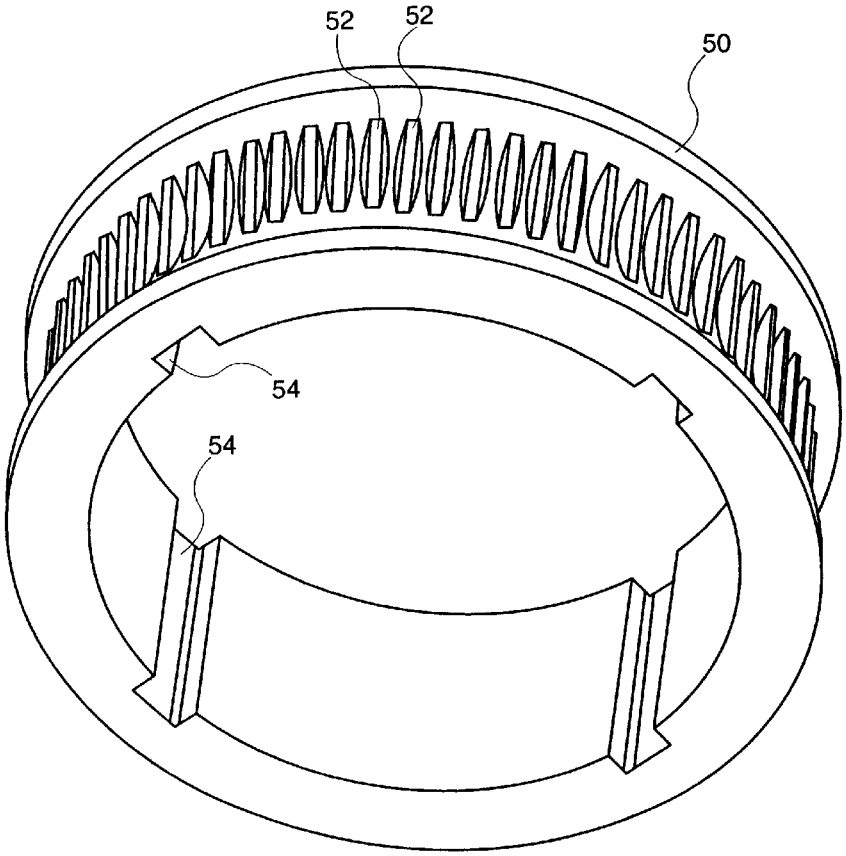
FIG. 8 is a perspective view of a gear, the rotatable member of FIG. 7.

Gear 50 is shown in greater detail in FIG. 8. Gear 50 may optionally include a plurality of ribs 52 which engage wheel 18 as described in greater detail hereinafter. Gear 50 includes a plurality of slots 54 which are received over elongate tabs 56 of insulating cylinder 48 to prevent rotation of gear 50 relative to shaft 44.

When rotatable member 36 is received in hole 35 of housing 34 (see FIG. 6) gear 50 is received into a curved slot 58 so that gear 50 will not come into contact with housing 34 except when engaging tabs 42 to indicate excessive wear of braking surfaces 40. In this matter, heat generated between braking surfaces 40 and shaft 44 will be substantially prevented from transferring to gear 50. In this manner, when gear 50 engages wheels 18 (see FIG. 2) heat will not be transferred to the wheels 18. Ribs 52 are optionally provided on gear 50 to prevent gear 50 from slipping when engaging wheels 18 as described in greater detail hereinafter.

Figure 9:
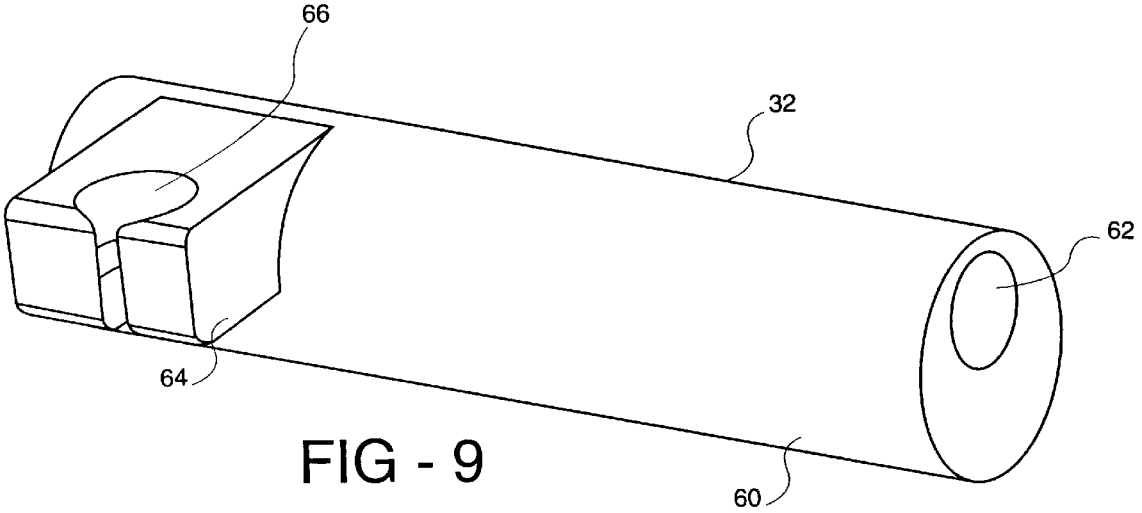
FIG. 9 is a perspective view of a cam actuator of the braking unit of FIG. 4.

Referring to FIG. 9, construction of cam 32 will be described. Cam 32 comprises an eccentric shaft 60 having a lumen 62 extending therethrough. A pin (not shown) is placed through lumen 62 to connect cam 32 to frame 14 as shown in FIG. 2. In this manner, cam 32 may be rotated relative to frame 14 when supplying a force to a lever arm 64. Lever arm 64 includes an aperture 66 to which a cable, rod, or the like may be placed to rotate cam 32. Cam 32 is rotatably received within a cylindrical opening 68 (see FIGS. 4 and 5) of housing 34. Since opening 68 is cylindrical, when cam 32 is rotated relative to housing 34, housing 34 will be directed downward relative to frame 14.

Referring back now to FIGS. 2 and 3, operation of braking units 26 and 28 to slow or stop wheels 18 of skates 10 will be described. Cam 32 of braking units 26 and 28 will preferably be interconnected by a cable or rod so that cam 32 of braking units 26 and 28 will be rotated at the same time and rate. Cams 32 of braking units 26 and 28 may be actuated by a cable or a rod extending to cuff 16 (see FIG. 1) so that as the cuff 16 is pivoted with the skater's leg, the braking system will be actuated. Other actuators include hydraulic actuators, solenoids, and the like.

Upon rotation of cam 32, elastomeric housing 34 is moved downward toward wheels 18 until gear 50 engages the pair of wheels 18 positioned below it. Preferably, gear 50 will engage both wheels above which it is positioned at substantially the same time. Further, since braking units 26 and 28 will preferably be actuated at the same time, all four wheels 18 will preferably come into contact with a respective gear 50 at the same time. Rotatable member 36 is completely rotatable within holes 35 so that as gear 50 comes into contact with wheels 18, rotatable member 36 will freely rotate. In this manner, the skater will not feel a sudden jerk as gear 50 engages wheels 18. Further since rotatable member 36 may freely rotate within hole 35 of housing 34, virtually no slippage will occur between gear 50 and wheels 18. In this manner, substantially no heat will be generated between wheels 18 and gear 50.

As cam 32 is further rotated, housing 34 begins to compress at slit 38. As housing 34 compresses, braking surfaces 40 (see FIG. 5) come into contact with shaft 44 (see FIG. 7). When shaft 44 engages braking surfaces 40, shaft 44 will be rotating due to engagement with wheels 18. Housing 34 will be constructed to be sufficiently resilient so that shaft 44 will slowly and gently come into contact with braking surfaces 40 so that no jerky movements will be felt by the skater. As cam 32 continues to rotate, braking surfaces 40 will be further pressed against rotating shaft 44 to slow shaft 44. In turn, gear 50 will slow engaged wheels 18. Since gear 50 includes ribs 52, gear 50 will not slip relative to wheels 18 to provide a smooth slowing of wheels 18.

The heat generated between shaft 44 and braking surfaces 40 will be transferred through fins 46 and dissipated into the atmosphere. Insulating cylinder 48 will substantially prevent any heat from transferring to gear 50 so that the heat created at the braking surfaces 40 will be substantially prevented from wheels 18 and causing damage thereto.

Since braking units 26 and 28 may be configured to equally engage all of the wheels 18, wheels 18 will generally be slowed at about the same rate and at about the same time. In this manner, one or more of the wheels will not prematurely lock up. Rather, all of wheels 18 will slow equally.

When the skater has sufficiently slowed or stopped, cam 32 are rotated in the opposite direction to lift braking units 26 and 28 from wheels 18 so that wheels may freely rotate.

Figure 10:
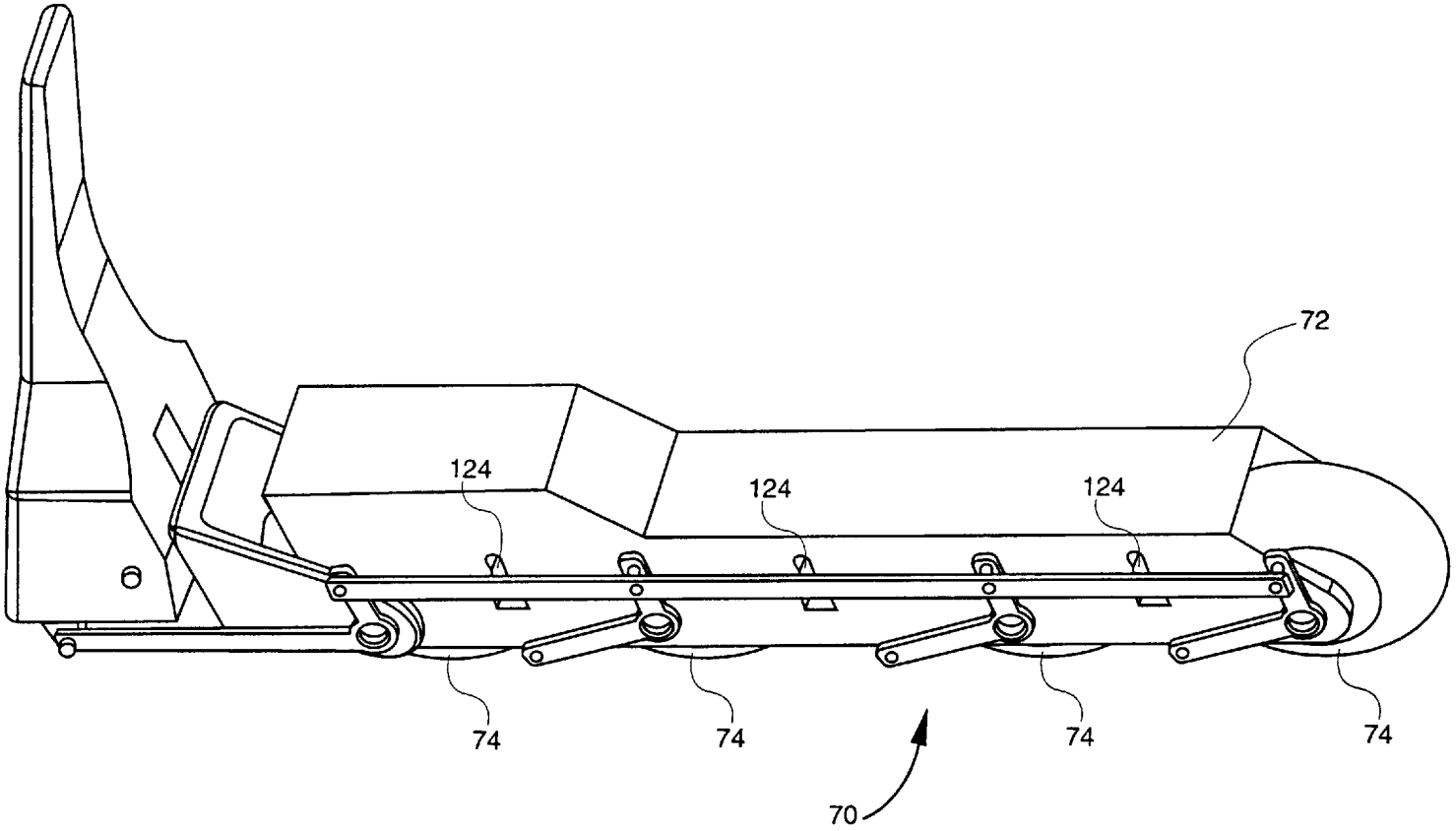
FIG. 10 is a perspective view of an alternative embodiment of a braking system according to the present invention.
Figure 11:
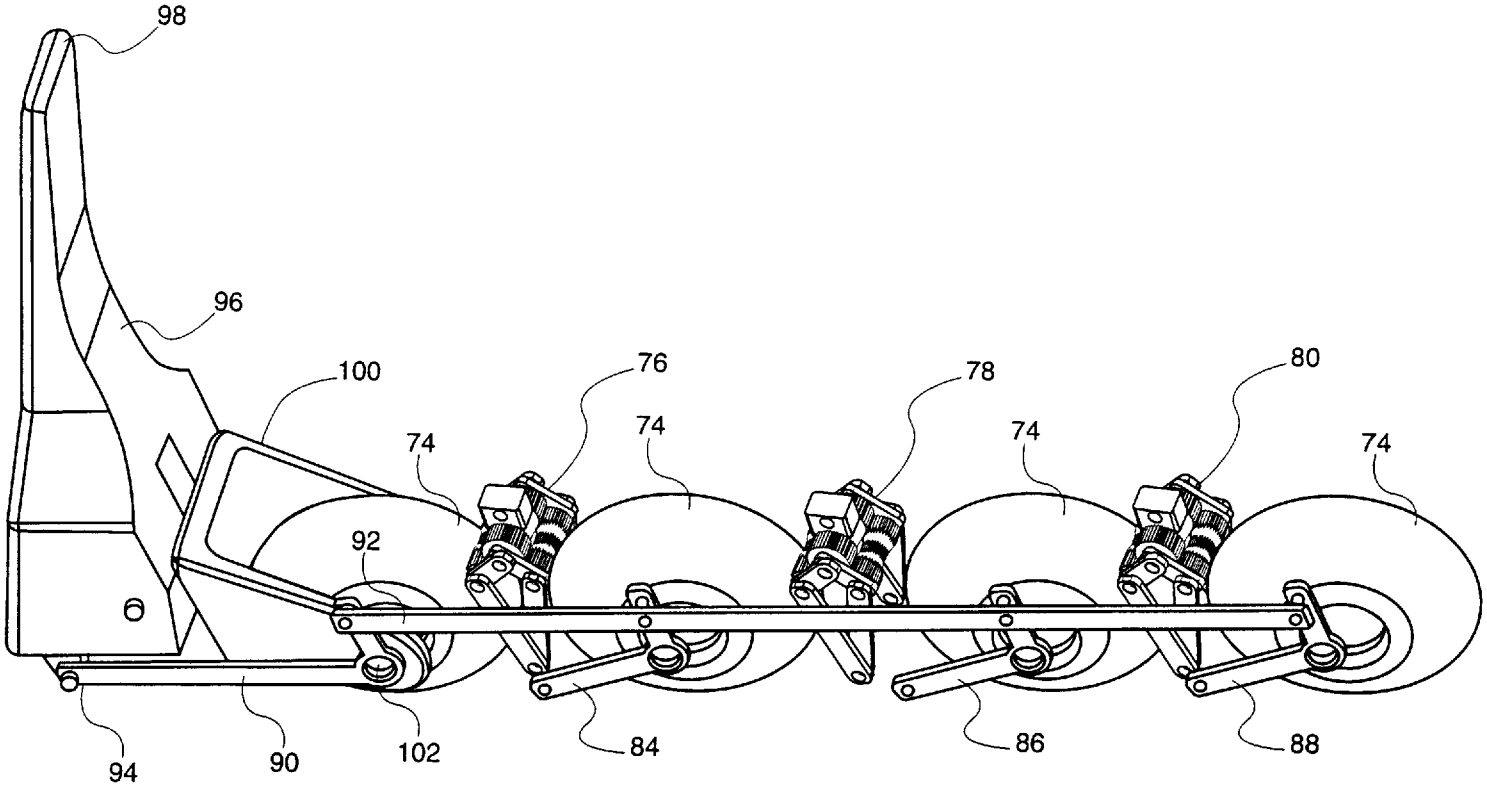
FIG. 11 illustrates the braking system of FIG. 10 with a skate frame being removed.

Referring to FIG. 10, an alternative embodiment of a braking system 70 will be described. Braking 70 includes a frame 72 which holds a plurality of in-line wheels 74 to a boot (not shown). As best shown in FIG. 11 (where frame 72 has been removed), braking system 70 further includes three braking units 76, 78 and 80. Braking system 70 may employ one or more of braking units 76, 78 and 80. Braking units 76, 78 and 80 are each interconnected to central rail 82 by rocker arms 84, 86 and 88. For convenience of illustration, rocker arms 84, 86 and 88 are shown disconnected from central rail 82 and braking unit 76, 78 and 80. However, it will be understood that appropriate pins will be provided to pivotally connect braking unit 76, 78 and 80 to central rail 82 via rocker arms 84, 86 and 88. A back rocker arm 90 is pivotally attached to a rear end 92 of central rail 82 and translates central rail 82 in a generally back and forth motion when an end 94 of back rocker arm 90 is translated up and down.

To translate end 94 in a generally up and down motion, a female member 96 is provided. Female member 96 is connected to a cuff of the roller skate boot (not shown) at a proximal end 98 similar to the female member described in copending U.S. application Ser. No. 08/571,795, filed Dec. 13, 1995 (Attorney Docket No. 17251-000600), the complete disclosure of which is incorporated herein by reference. Female member 96 slides over a male member (not shown) which is attached to a carriage 100 which is nonmovably attached to a rear axle 102 of rear wheel 74. In this manner, as the boot cuff is pivoted back and forth by the skater's leg, female member 96 is translated in a generally up and down motion to translate central rail 82 in a generally back and forth motion. Often, female member 96 may include a braking pad as described in co-pending U.S. application Ser. No. 08/571,795, previously incorporated by reference. It will be understood that other actuators may be employed to translate central rail 82 including a hydraulic system, a solenoid, and the like.

As female member 98 is translated downward, rocker arms 84, 86 and 88 pivot about the axles of wheels 74 to move braking 76, 78 and 80 into contact with wheels 74.

Figure 12:
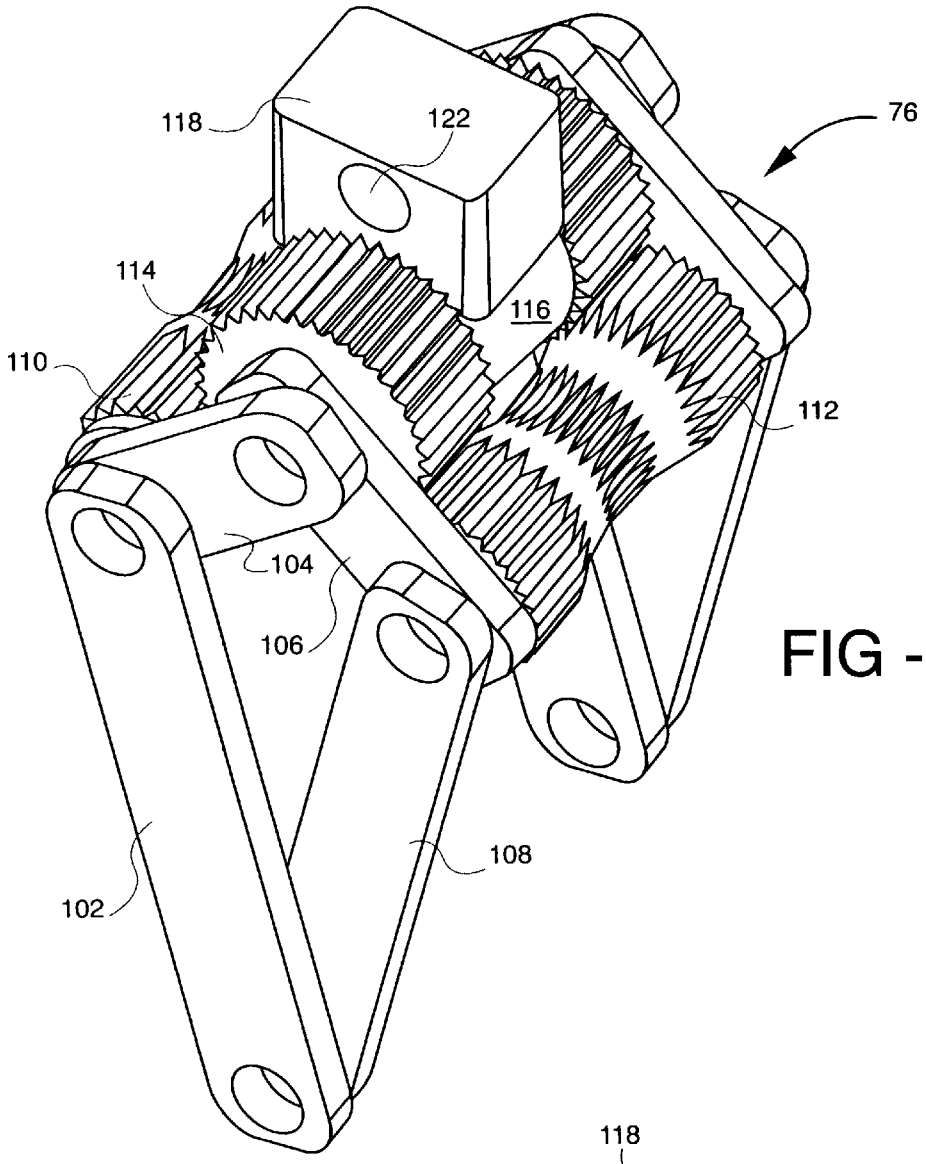
FIG. 12 is a perspective view of a braking unit of the braking system of FIG. 11.
Figure 13:
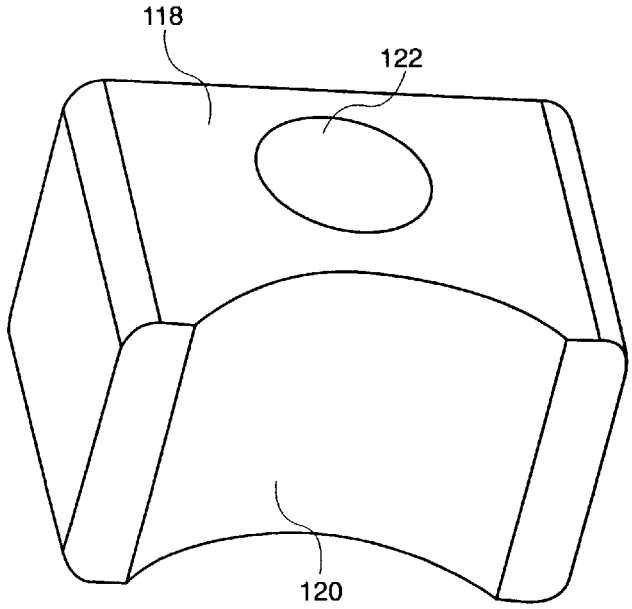
FIG. 13 is a perspective view of a braking pad of the braking unit of FIG. 12.

Referring now to FIG. 12, operation of braking unit 76, 78 and 80 will be described. FIG. 12 illustrates braking unit 76, it being understood that braking units 78 and 80 are essentially identical to braking unit 76. Braking unit 76 includes four linkages 104, 106, 108 and 110 on each side. Linkages 104–108 are pivotally connected to each other by pivot pins (not shown). Braking unit 76 further includes two side gears 110 and 112 and a center gear 114. Side gears 110 and 112 come into contact with wheels 74 when braking unit 76 is lowered. Side gears 110 and 112 may optionally include ribs to prevent slippage of wheel 74 relative to side gears 110 and 112. Center gear 114 includes a central portion 116 which is spaced apart from the braking pad 118. Braking pad 118 is shown in FIG. 13 and includes a braking surface 120 which is designed to contact central portion 116 of gear 114. Braking pad 118 is preferably constructed of an elastomeric material such as rubber. Braking pad 118 is mounted to frame 72 (see FIG. 10) by a pin (not shown) extending through a lumen 122 of braking pad and into an aperture 124 of frame 72.

Referring back now to FIG. 11, operation of braking system 70 to slow or stop the skate will be described. When female member 96 is translated downward, rocker arms 84, 86 and 88 will pull on linkages 102 and 108 until side gears 110 and 112 come into contact with adjacent wheels 74. As side gears 110 and 112 contact wheels 74, they will begin to rotate. In turn, central gear 114 will also rotate. Since braking pad 118 is spaced apart from central portion 116, center gear 114 will freely rotate and will not cause a jerking reaction that may be felt by the skater. As female member 96 is translated further downward, linkages 102 and 108 are forced together to drive gear 114 toward braking pad 118. As central portion 116 engages braking pad 118, rotation of center gear 114 will gently begin to slow in turn causing side gears 110 and 112 to slow, thereby smoothly slowing the engaged wheels 74.

Side gears 110 and 112 and/or portions of center gear 114 will preferably be constructed of an insulated material such as a ceramic, so that heat generated between central portion 116 and braking pad 118 will not be transferred to wheels 74. In this manner, the heat generated in slowing or stopping wheels 74 will be kept away from the wheels. After wheel 74 has been slowed to the desired amount, female member 96 is translated upwards to disengage braking unit 76, 78 and 80 from wheels 74.

Although the foregoing invention has been described in some detail for purposes of clarity of understanding, alternative embodiments of the invention will occur to those skilled in the art. For example, a skate could be fashioned so that each wheel contains an integral gear that meshes continually with an accompanying gear in the frame of the skate (often referred to as the skate rack). Each gear in the skate rack is coaxially attached to a cylindrical friction surface, each of which rotates whenever the skate is in motion. For instance, an inline skate utilizing the typical four-wheel rack would contain four separate gears, each meshing with one of the four wheel gears. During normal skating, all four skate rack gears and the attached friction surface rotate freely about their respective axis, providing virtually no resistance to wheel rotation. Upon application of a force balancing brake mechanism (which may be actuated by cuff actuation in a manner similar to that previously described), the frictional surfaces are applied with equal force to four rotating friction shafts. The resulting friction between the brake mechanism and the friction shafts results in the transmission of a resistive torque through the four gears mounted in the skate rack. This torque in turn is transmitted to each of the four wheels which in turn serve to slow the skate's forward motion.

Such a configuration may be modified so that all four wheels may be geared together continuously, such that the entire wheel/rack assembly behaves as a unitized gear train at all times. Alternatively, the wheel/rack assembly could be made to behave as a gear train only at the time of braking, such that the wheels can rotate independently of one another during normal skating but engaged just prior to the time of braking. Gearing the wheels together in this fashion would serve to reduce the tendency of any one wheel to lock during hard braking conditions on rough or uneven surfaces.

Therefore, the above description should not be taken as limiting the scope of the invention. Instead, the scope of the invention should be determined chiefly with reference to the appended claims, along with the full scope of equivalents to which those claims are entitled.

What is claimed is:

1. A braking system for a roller skate having a plurality of wheels, the system comprising:

at least one braking surface spaced-apart from the wheels; and means between the braking surface and at least one of the wheels for slowing or stopping the wheel such that heat generated when slowing or stopping the wheel is created at the braking surface and is substantially prevented from reaching the wheel.

2. A system as in claim 1, wherein the wheels of the roller skate are in-line with each other, and wherein the means for slowing or stopping is positioned between two of the in-line wheels so that the two wheels may be slowed or stopped at substantially the same time.

3. A system as in claim 1, wherein the means for slowing or stopping comprises a rotatable member which may be positioned to contact one of the wheels when rotating, wherein positioning of the rotatable member against the wheel causes the rotatable member to rotate, and wherein engagement of the braking surface with the rotating rotatable member slows rotation of the in-line wheel.

4. A system as in claim 3, wherein substantially no slippage occurs between the wheel and the rotatable member so that heat generated while slowing the wheel is generated away from the wheel at the braking surface.

5. A system as in claim 3, wherein the rotatable member may be positioned to contact two of the wheels at substantially the same time, wherein the two contacted wheels may be slowed by the rotatable member.

6. A system as in claim 3, further comprising an actuator which positions the rotatable member against the wheel and engages the braking surface with the rotatable member.

7. A system as in claim 6, wherein the actuator comprises a cam which moves the rotatable member into contact with the wheel upon rotation of the cam.

8. A system as in claim 7, further comprising a cable connected to the cam, whereby the cam may by rotated by pulling on the cable.

9. A system as in claim 7, further comprising an elastomeric housing, wherein the braking surface is formed within the housing, and wherein the rotatable member is rotatably attached to the housing so as to be spaced-apart from the braking surface such that rotation of the cam forces the braking surface against the rotatable member after the rotatable member contacts the wheel.

10. A braking system for a roller skate having a plurality of in-line wheels which rotate when the roller skate is rolling over a skating surface, the system comprising:

a rotatable member which may be positioned to contact at least one of the wheels when rotating, wherein positioning of the rotatable member against the wheel causes the rotatable member to rotate; and a braking surface engageable with the rotatable member, wherein engagement of the braking surface with the rotating rotatable member slows rotation of the in-line wheel.

11. A system as in claim 10, wherein substantially no slippage occurs between the wheel and the rotatable member so that heat generated while slowing the wheel is generated away from the wheel at the braking surface.

12. A system as in claim 10, wherein the rotatable member may be positioned to contact two of the wheels at substantially the same time, wherein the two contacted wheels may be slowed by the rotatable member.

13. A system as in claim 10, wherein at least a portion of the rotatable member is thermally conductive so that heat generated between the rotatable member and the braking surface may be dissipated into the atmosphere.

14. A system as in claim 13, wherein at least a portion of the rotatable member is constructed of aluminum and includes a plurality of heat transfer ribs.

15. A system as in claim 13, wherein the rotatable member includes insulation for preventing heat generated at the braking surface from transferring to the wheel.

16. A system as in claim 10, further comprising an actuator which positions the rotatable member against the wheel and engages the braking surface with the rotatable member.

17. A system as in claim 16, wherein the actuator comprises a cam which moves the rotatable member into contact with the wheel upon rotation of the cam.

18. A system as in claim 17, further comprising a cable connected to the cam, whereby the cam may by rotated by pulling on the cable.

19. A system as in claim 17, further comprising an elastomeric housing, wherein the braking surface is formed within the housing, and wherein the rotatable member is rotatably attached to the housing so as to be spaced-apart from the braking surface such that rotation of the cam forces the braking surface against the rotatable member after the rotatable member contacts the wheel.

20. A system as in claim 19, wherein the cam is rotatably connected to a skate frame.

21. A roller skate, comprising:

a boot;

a frame which connects a plurality of in-line wheels to the boot;

a braking surface operable attached to the frame; and means between the braking surface and at least one of the wheels for slowing or stopping the wheel such that heat generated when slowing or stopping the wheel is created at the braking surface and is substantially prevented from reaching the wheel.

22. A method for slowing or stopping a moving roller skate, comprising:

contacting a rotating wheel of the roller skate with a rotatable member;

slowing the rotatable member such that heat energy created in slowing the rotatable member is substantially prevented from reaching the wheel.

23. A method as in claim 22, wherein the slowing step further comprises positioning a braking surface against the rotatable member such that substantially no slippage is created between the wheel and the rotatable member.

24. A method as in claim 23, wherein the roller skate further comprises an elastomeric housing having the braking surface formed therein, and wherein the rotatable member is rotatably attached to the housing so as to be spaced-apart from the braking surface, and wherein the positioning step comprises compressing the housing to force the braking surface against the rotatable member after the rotatable member contacts the wheel.

25. A method as in claim 24, further comprising rotating a cam to position the braking surface against the rotatable member.

26. A method as in claim 25, further comprising rotating a cuff on the roller skate to rotate the cam.

* * * * *